US008450654B2

(12) United States Patent
Lehman et al.

(10) Patent No.: US 8,450,654 B2
(45) Date of Patent: May 28, 2013

(54) METHOD AND APPARATUS FOR TRANSFERRING HEAT TO A SURFACE

(75) Inventors: Lon Lehman, Ft. Wayne, IN (US); Eugene Tippman, Jr., Ft. Wayne, IN (US)

(73) Assignee: Unified Brands, Inc., Jackson, MS (US)

( * ) Notice: Subject to any disclaimer, the term of this patent is extended or adjusted under 35 U.S.C. 154(b) by 815 days.

(21) Appl. No.: 12/550,924

(22) Filed: Aug. 31, 2009

(65) Prior Publication Data

US 2010/0108659 A1 May 6, 2010

Related U.S. Application Data

(60) Provisional application No. 61/110,355, filed on Oct. 31, 2008.

(51) Int. Cl.
*A21B 1/00* (2006.01)

(52) U.S. Cl.
USPC ..... 219/405; 219/399

(58) Field of Classification Search
USPC ..... 219/405, 400, 399, 391
See application file for complete search history.

(56) References Cited

U.S. PATENT DOCUMENTS

| | | | | |
|---|---|---|---|---|
| 3,241,542 | A | 3/1966 | Lotter | |
| 4,607,609 | A | 8/1986 | Keating | |
| 4,878,424 | A | 11/1989 | Adamson | |
| 5,619,910 | A | 4/1997 | Farnsworth et al. | |
| 5,620,623 | A * | 4/1997 | Baker | 219/400 |
| 5,676,043 | A | 10/1997 | Best | |
| 5,811,763 | A * | 9/1998 | O'Rorke | 219/411 |
| 5,964,145 | A | 10/1999 | Brown | |
| 6,138,554 | A | 10/2000 | McFadden | |
| 6,874,565 | B2 * | 4/2005 | Wagner | 165/80.3 |

FOREIGN PATENT DOCUMENTS

EP 0197905 10/1986

* cited by examiner

*Primary Examiner* — Charles Garber
*Assistant Examiner* — Reema Patel
(74) *Attorney, Agent, or Firm* — Butler, Snow, O'Mara, Stevens & Cannada PLLC

(57) ABSTRACT

A heating apparatus is disclosed having a first region containing a heat source and a second region that is separate from and thermally coupled with the first region via an interface element. The heating apparatus also includes a convection deflector disposed within the interior of the first region to direct convective heat towards the interface element. The deflector can have a geometric shaped cross-section with a first side oriented towards the heat source and an opposing second side oriented away from the heat source. The first and second sides are adapted to reflect radiant and convective heat.

17 Claims, 3 Drawing Sheets

METHOD AND APPARATUS FOR TRANSFERRING HEAT TO A SURFACE

This application claims the benefit of U.S. Provisional Application No. 61/110,355, filed Oct. 31, 2008, which is hereby incorporated by reference in its entirety.

BACKGROUND

1. Field of the Invention

The present invention relates generally to heat transfer. More particularly, the present invention relates to heat transfer in a heating apparatus from one region of the apparatus to another.

2. Description of the Related Art

Traditional heating equipment operates by transferring heat from a heat source to a surface. In some heating equipment, such as certain cooking equipment, the heated surface is in direct contact with a substance to be heated. For example, food cooked by direct contact with the surface of a grill, which directly transfers the heat it receives from a heat source to the food. In other heating equipment, the heated surface transfers heat to the substance to be heated through indirect conveyance. For example, in a steam kettle, the surface closest to the heat source is in contact with water and, when heated, transfers heat to the water to produce steam. The steam, acting as an intermediary, then transfers heat to another surface that is in direct contact with a substance to be heated, such as soup. Whether the heated surface directly or indirectly heats a substance, the effectiveness of the surface's heating ability is dependent upon the heat transfer characteristics of the surface material and its proximity to the heat source. Problems occur, however, when the heat transfer characteristic of the surface is inferior. For example, with such inferior surfaces, heat tends to be localized in the vicinity of the heat source, thus causing uneven distribution of heat across the area of the surface. What is needed, therefore, is a method and apparatus for improving the heat transfer characteristics of heating apparatus equipment made from material of poor thermal conductivity.

SUMMARY

The present invention has been developed to address the above and other problems in the related art. According to exemplary embodiments of the present invention, a heating apparatus is disclosed that includes a first region containing a heat source, a second region that is separate from and thermally coupled with the first region via an interface element, and a convection deflector. The convection deflector is disposed within the interior of the first region to direct heat towards the interface element. The deflector can have a geometric shaped cross-section with a first side oriented towards the heat source and an opposing second side oriented away from the heat source. The first and second sides are adapted to reflect radiant and convective heat.

According to exemplary embodiments of the present invention, a method of enhancing heat transfer is disclosed. The method includes providing a first region that contains a heat source for causing radiant and convective heat. The first region also contains a convection deflector disposed therein. The method further includes providing a second region that is separate from and thermally coupled with the first region via an interface element. The deflector directs convective heat flowing within the first region towards the interface element. The deflector can have a geometric shaped cross-section with a first side oriented towards the heat source and an opposing second side oriented away from the heat source. The first and second sides are adapted to reflect radiant and convective heat. In this manner, heat transfer between the two regions is increased.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The above and/or other exemplary features and advantages of the preferred embodiments of the present invention will become more apparent through the detailed description of exemplary embodiments thereof with reference to the accompanying drawings, in which.

Throughout the drawings, like reference numbers and labels should be understood to refer to like elements, features, and structures.

DETAILED DESCRIPTION

Exemplary embodiments of the present invention will now be described more fully with reference to the accompanying drawings. The matters exemplified in this description are provided to assist in a comprehensive understanding of various embodiments of the present invention disclosed with reference to the accompanying figures. Accordingly, those of ordinary skill in the art will recognize that various changes and modifications of the embodiments described herein can be made without departing from the scope and spirit of the claimed invention. Descriptions of well-known functions and constructions are omitted for clarity and conciseness. To aid in clarity of description, the terms "upper," "lower," "above," "below," "left" and "right," as used herein, provide reference with respect to orientation of the accompanying drawings and are not intended to be limiting.

In commercial as well as residential applications, it is desirable to use heating equipment made from stainless steel. Stainless steel is durable, resistant to corrosion, and easy to maintain; it is ideal for environments requiring high levels of sanitation, such as hospitals and food service establishments. Stainless steel has a drawback, however, in that it has low thermal conductivity relative to other materials. For example, the thermal conductivity of aluminum is 118 Btu/(hr-ft-° F.), gold 182 Btu/(hr-ft-° F.) and copper 223 Btu/(hr-ft-° F.), whereas stainless steel has a thermal conductivity of 11 Btu/(hr-ft-° F.). Because the thermal conductivity of stainless steel is low relative to other materials, heat received from the heat source tends to be localized in the area of the heat source and not uniformly distributed across the surface of the heating apparatus. Thus, what is needed is a method and apparatus for improving the heat transfer characteristics of heating apparatus equipment made from stainless steel or other material of poor thermal conductivity.

Figure 1:
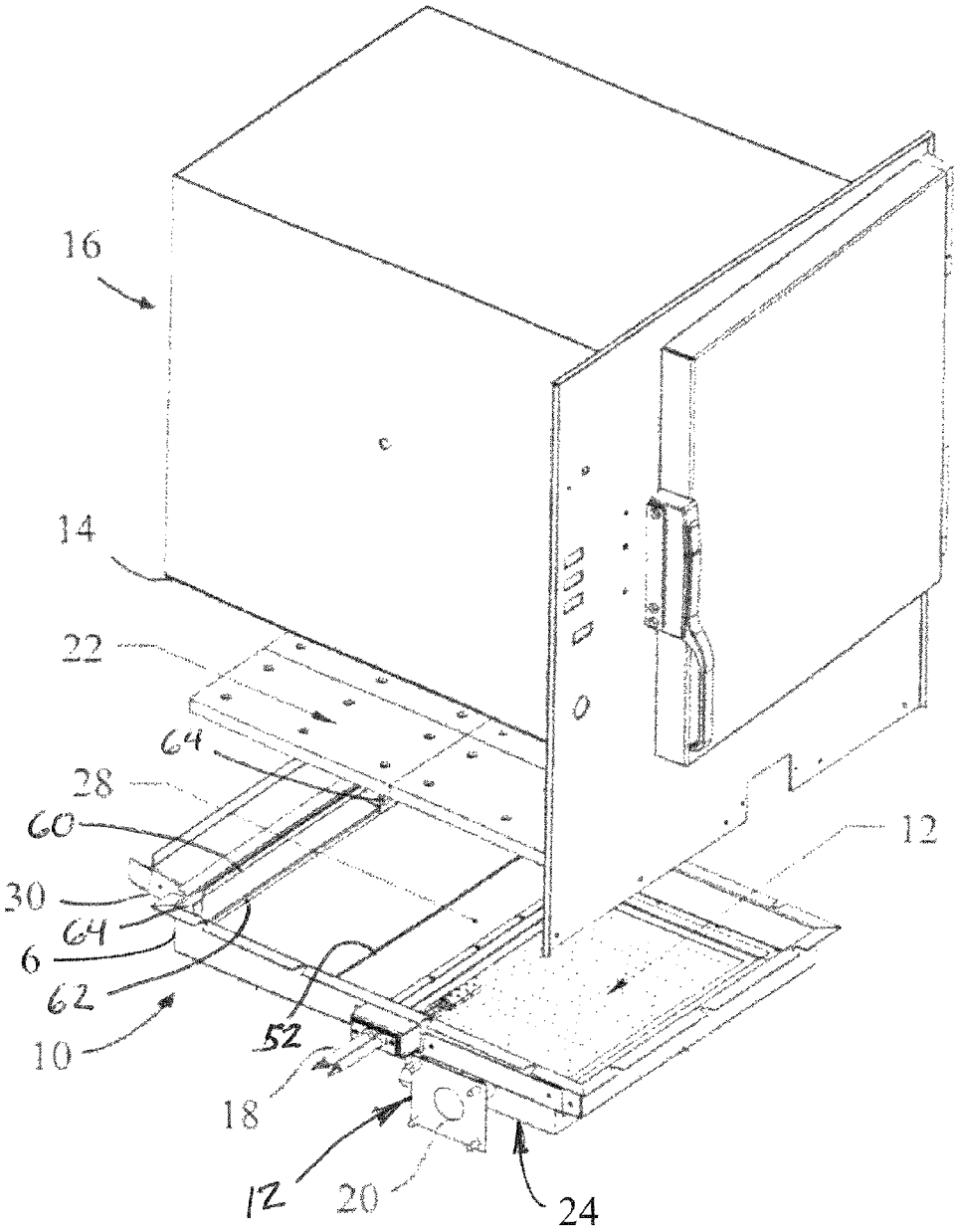
FIG. 1 illustrates an exploded perspective view of a heating apparatus in accordance with an embodiment of the present invention.

FIG. 1 illustrates an exploded perspective view of a heating apparatus in accordance with an embodiment of the present invention. As will be described in detail below, a novel manner of transferring heat is disclosed. The novel heat transfer of the present invention enhances thermal efficiency as compared to conventional heating units.

Referring to FIG. 1, a first region of heating apparatus 10 includes heat source 12, igniter 18, fuel supply inlet 20, manifold 24, and deflector 28. A flue 30 is fluidically coupled to the first region at a sidewall 6 of manifold 24 and provides an exhaust path for effluent to evacuate. Sidewall 6 forms a boundary of the first region and includes top wall portion 60, bottom wall portion 62, and end wall portions 64. A second region of heating apparatus 10 includes heating chamber 16 and is separated from the first region by interface element 14, which accepts heat produced by heat source 12 for transfer to heat chamber 16. In exemplary embodiments interface element 14 separates the first and second regions in a sealed manner preventing hot gas in the first region from reaching heat chamber 16. Interface element 14 includes a first surface disposed within the first region and a second surface disposed within the second region. Heating chamber 16 is adapted to contain a substance to be heated. A heat sink 22 is preferably provided to assist in distributing heat over interface element 14. In an exemplary embodiment, the first region is positioned below the second region, with interface element 14 providing the interface between the two regions. Exemplary embodiments provide interface element 14 as coated with a thermal compound to increase thermal conductivity.

Fuel is supplied, via inlet 20, to manifold 24 where it combines with air, combusts, and is then distributed to heat sink 22. Manifold 24 includes a lower portion 44 for receiving gas from fuel supply inlet 20 and an upper portion 46 for supporting the igniter 18 and deflector 28, and distributing the hot gas over heat sink 22. An upper edge of upper portion 46 may be formed at angle so that side wall 6 at one end is taller than the opposite side wall 7 (FIG. 3) at the opposite end of upper portion 46. In this manner, heat sink 22 is likewise angled upwardly toward flue 30 enhancing the natural flow of hot gas toward flue 30. An optional fan can be provided to produce pressure in the manifold to optimize the air/fuel mixture and distribution over heat sink 22. In an exemplary embodiment, heat source 12 is a gas fired infrared heater. Alternatively, heat source 12 can be a conventional gas burner or electric heater. When heat source 12 is electric, fuel is not an essential component to the primary heating mechanism and thus optional, although fuel can be present in dual electric/gas appliances.

When fuel is burned, igniter 18 initiates a spark at its electrode to combust the air/fuel mixture for distribution over heat source 12, causing the temperature to rise to an infrared radiation emitting level. Heat thus produced is primarily conveyed by radiation and convection. Radiated heat rises and mixes with the circulating convective heat, with the resultant heat flow vector resolving into vertical and horizontal components. The vertical component flows directly to interface element 14 via heat sink 22 when provided. The horizontal component flows generally towards, or is reflected towards, deflector 28.

Through operation of deflector 28, virtually all of the heat generated by heat source 12 is directed to interface element 14. As interface element 14 absorbs heat, it transfers heat to the second region. In an exemplary embodiment, interface element 14 may be any surface, such as a flat surface formed of, for example, stainless steel, that is in direct contact with a product to be heated, such as a food product or water, causing the heat absorbed by interface element 14 to be directly transferred to the product. In the exemplary embodiment shown in FIGS. 1-3, a thermally conductive fluid 26, i.e., water, is placed within the cavity to absorb heat from interface element 14 sufficiently to be converted to steam. The steam rises in heat chamber 16 to heat the product positioned in heat chamber 16. The food product may be exposed directly to the steam, or packaged or positioned in other containers placed in chamber 16 on, for example, wire racks. The heating apparatus and method of the present invention may be applied to a conventional heating apparatus, for example, the Intek XS Steamer manufactured by Intek Manufacturing LLC.

Figure 2:
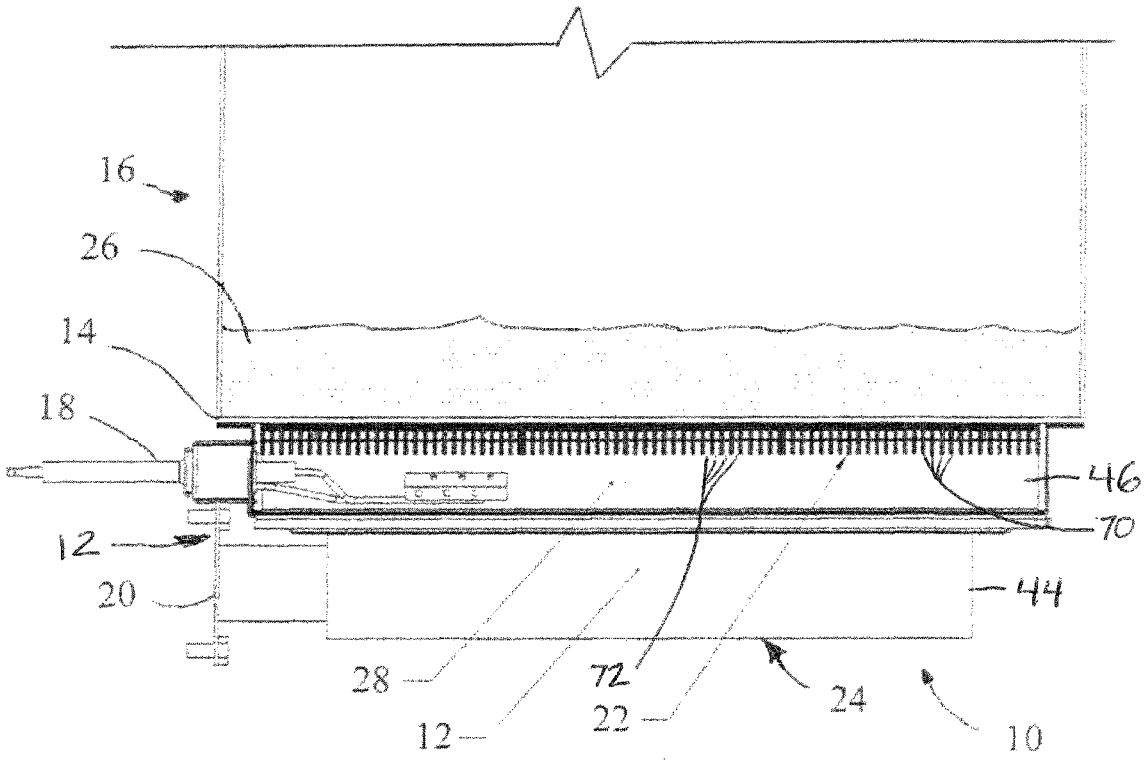
FIG. 2 illustrates a partial cross-sectional view of the heating apparatus of FIG. 1 as assembled and taken along plane 2-2 in FIG. 1.

FIG. 2 illustrates a partial cross-sectional view of a heating apparatus in accordance with the embodiment of FIG. 1. In the exemplary embodiment shown in FIG. 2, heat sink 22 is shown in cross-sectional profile comprising a plurality of heat collecting protrusions or fins 70 separated by a plurality of grooves 72. This design increases the surface area available for heat collection. Heat sink 22 is made of a material having superior thermal conductivity to that of interface element 14. In the preferred embodiment, heat sink 22 is formed of extruded aluminum. Heat sink 22 is heated by two heat transfer mechanisms in that it receives radiant energy from heat source 12 and heat by convection from the effluent produced during combustion. Heat sink 22 is secured to interface element 14 so that it is thermally coupled to the second region but is disposed within the first region to collect heat generated by heat source 12. In exemplary embodiments, heat sink 22 is preferably dark in color, for example, black, to assist in the efficient and effective absorption and transfer of heat. In exemplary embodiments, heat sink 22 may be secured to interface element 14 via a thermally conductive compound, such as a thermally conductive paste or adhesive. The thermally conductive compound may be Type Z9 Silicone Heat Sink Compound provided by GC Electronics.

Figure 3:
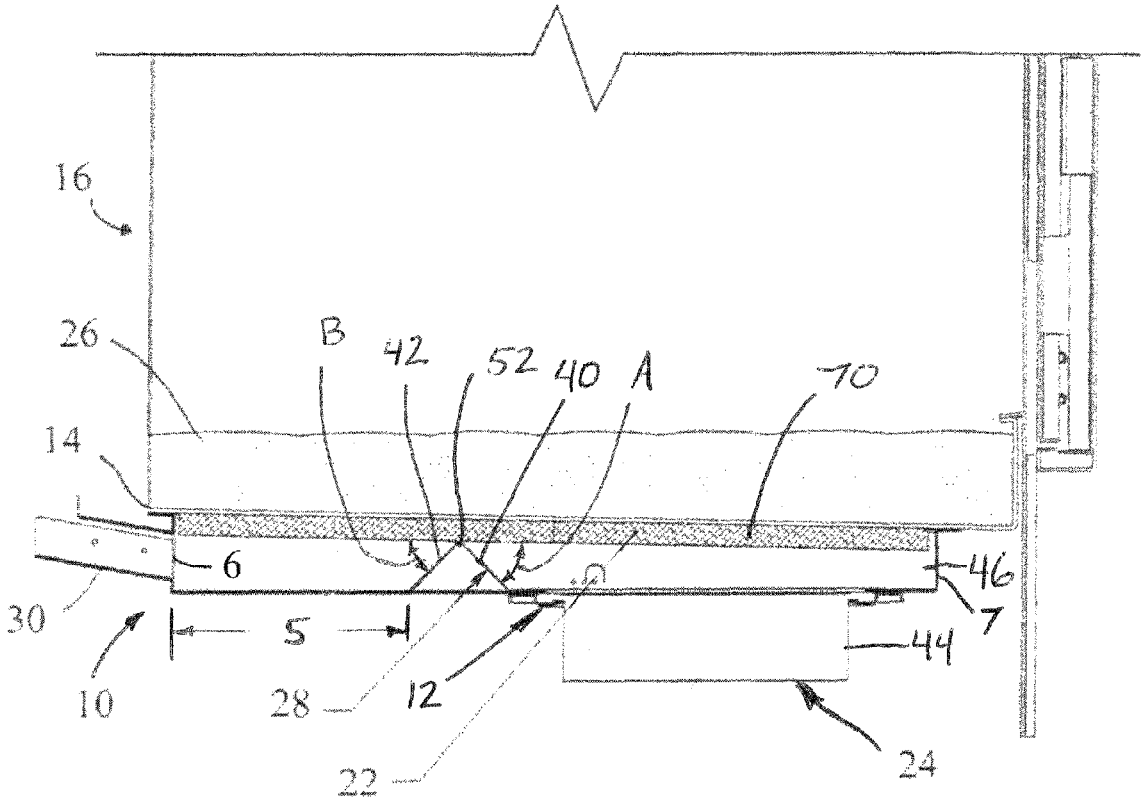
FIG. 3 illustrates a partial cross-sectional view of a heating apparatus of FIGS. 1 and 2 as assembled and taken along plane 3-3 in FIG. 2.

FIG. 3 illustrates a partial cross-sectional view of a heating apparatus in accordance with an embodiment of the present invention. In the exemplary embodiment shown in FIG. 3, convection deflector 28 is shown in cross-sectional profile and located immediately adjacent to heat source 12, and thus positioned with the lower edge of deflector 28 positioned a maximum spaced distance 5 from sidewall 6. By positioning deflector 28 immediately adjacent heat source 12 thereby maximizing the spaced distance 5, the hot gas flowing from manifold 24 is forced to flow across heat sink 22 and interface element 14 during its initial movement laterally towards flue 30. This flow path increases heat transfer by forcing the hot gas to flow over through the fins of the heat sink and over the heat sink surfaces. In a preferred embodiment, convection deflector 28 includes a first side 40 and a second side 42 connected at a top edge 52. First and second side 40, 42 extend downwardly at an angle from one another so that first side 40 is oriented to face toward heat source 12 and second side 42 oriented to face toward sidewall 6, away from heat source 12. The first and second sides each have a lower edge positioned a spaced distance apart. The upper surfaces of each side 40, 42 extend from heat sink 22 downwardly at respective acute angles A, B from the plane of the heat sink 22 thereby positioning the upper surfaces of each side to reflect gas upwardly toward heat sink 22. Maximizing the spaced distance 5 also enhances heat transfer to heat sink 22 by the gas reflected from wall 6 back toward side 42 (as discussed hereinbelow) since the reflected gas is deflected upward toward fins 70 and must travel a larger distance back to flue 30. The first and second sides of deflector 28 can be polished or coated at least on the upper surfaces to improve heat reflection. Although the cross-sectional profile of deflector 28 in the preferred embodiment is V-shaped, exemplary embodiments provide a cross-sectional profile that can comprise any geometric shape, such as a curve or polygon, and oriented in a manner to accommodate reflective heat transfer.

The height of deflector 28 preferably extends to the top of the first region, that is, to interface element 14 or heat sink 22, or assume a lower profile such that there is an open space between the top of deflector 28 and the top of the first region. In embodiments having a finned heat sink 22, top edge 52 of deflector 28 is preferably and advantageously positioned in abutment against, or immediately adjacent to, the lower edges of the fins so as to force substantially all the convective heat to flow through the space between the fins to heat a larger area of heat sink 22. By extending deflector 28 upwardly to contact finned heat sink 22, and using a deflector sized and dimensioned to extend across the entire width of upper portion 46 of manifold 24 (i.e. the first region), the gas flow path from manifold 24 to flue 30 is blocked except through the grooves 72 formed in heat sink 22. As a result, virtually all the hot gas/effluent formed in manifold 24 is forced to flow over fins 70, through grooves 72 thereby ensuring optimal heat transfer to heat sink 22 and ultimately the second region of the heating apparatus. In certain embodiments, the first and second sides of deflector 28 may have solid protrusions, for example, in the form of channels. In the preferred embodiment, first side 40 and second side 42 terminate at the bottom surface of the first region so that convective heat cannot flow underneath deflector 28; that is, first side 40 and second side 42 abut or connect to the bottom surface of the first region in such a manner that there is an inherent seal and heat flow is deflected upward. Also in the preferred embodiment, deflector 28 extends across the entire space of the first region, thus prohibiting convective heat from flowing around the ends. Exemplary embodiments provide one or more fans disposed within the first region to direct convection heat towards one or both sides of deflector 28.

In operation, the horizontal component of the convective heat flow strikes first side 40 of deflector 28 and is reflected upwardly towards the top of the first region, that is, to interface element 14 or heat sink 22. Convective heat (gas) flow passing beyond deflector 28, i.e., over the top, will travel to sidewall 6 at the end of the first region. In embodiments having a finned heat sink 22 and deflector 28 extending to the top, convective heat can flow through the space between fins. Some heat flow will evacuate through flue 30, but the remainder will reflect off wall portions 60, 62, 64 of wall 6, and return back towards deflector 28, striking second side 42 and reflecting upwardly towards the top of the first region. Thus heat flow that is deflected up actually flows through two or more passes over at least a portion of heat sink 22. In this manner, a circuitous path for the heat flow is provided, thus extracting a maximum amount of heat and improving the heat transfer efficiency of heating apparatus 10.

The present invention effectively combines several features to obtain advantages over existing designs. In particular, the present heating apparatus includes a finned heat sink having grooves positioned in the heat flow path for maximizing heat transfer surface area and a deflector to ensure gas flow through the apparatus to achieve optimum heat transfer and, wherein the heat sink is dark, i.e., black, in color and/or attached to the underside of a stainless steel surface using a thermal transfer compound. Preferably the deflector is sized, shaped, and positioned to reflect all gas flow through the heat sink grooves and also preferably sized, shaped, and positioned to deflect reflected outgoing gas flow upwardly back towards the heat sink again.

While the present invention has been particularly shown and described with reference to certain exemplary embodiments thereof, it will be understood by those of ordinary skill in the art that various changes in form and detail may be made therein without departing from the spirit and scope of the present invention as defined by the appended claims. For example, embodiments have been described by way of application of a general heating apparatus but the invention disclosed herein is capable of being employed in cooking, such as, for example, griddles, skillets, tilting skillets and steam kettles, and warming, drying or any other such application.

What is claimed is:

1. A heating apparatus, comprising:

a first region containing a heat source;

a second region separate from and thermally coupled with said first region via an interface element; and a convection deflector disposed within the interior of said first region to direct convective heat towards said interface element, said deflector having a geometric shaped cross-section and a first side oriented towards said heat source and an opposing second side oriented away from said heat source, said first and second sides being adapted to reflect heat.

2. The heating apparatus of claim 1, wherein the top of said convection deflector is below said interface element to permit convective heat flow to pass above said convection deflector.

3. The heating apparatus of claim 1, further comprising:

a heat sink thermally coupled to said interface element and disposed within said first region.

4. The heating apparatus of claim 3, wherein said heat sink includes heat-collecting fins.

5. The heating apparatus of claim 3, wherein said heat sink comprises a block formed of thermally conductive material.

6. The heating apparatus of claim 4, wherein a top of said convection deflector is substantially at the tip of said heat-collecting fins, thereby permitting convective heat to flow between said fins.

7. The heating apparatus of claim 1, further including a flue positioned to direct gas from said first region, wherein said convection deflector is positioned adjacent said heat source between said heat source and said flue, and a maximum distance from said flue.

8. The heating apparatus of claim 1, wherein said second region includes a heating chamber for containing a substance to be heated.

9. The heating apparatus of claim 1, wherein said heat source comprises an infrared heater.

10. A heating apparatus, comprising:

a first region containing a heat source;

a second region separate from and thermally coupled with said first region via an interface element; and a convection deflector disposed within the interior of said first region to direct convective heat towards said interface element, said deflector having a geometric shaped cross-section and a first side oriented towards said heat source and an opposing second side oriented away from said heat source, said first and second sides being adapted to reflect heat, and wherein said first and second sides of said convection deflector intersect to form a top edge, said first and said second sides extending from said top edge at an angle to deflect heat upward via each side, each of said first and said second sides connecting to the first region at a lower edge.

11. The heating apparatus of claim 10, said first region having a sidewall to form a boundary, wherein said convection deflector is located between said heat source and said sidewall such that a spaced distance arises between the lower edge of the second side of said convection deflector and said sidewall.

12. A method of enhancing heat transfer, the method comprising:

providing a first region containing a heat source for causing radiant and convective heat, said first region further containing a convection deflector disposed therein; and providing a second region separate from and thermally coupled with said first region via an interface element, wherein said deflector directs convective heat flowing within said first region towards said interface element, said deflector having a geometric shaped cross-section and a first side oriented towards said heat source and an opposing second side oriented away from said heat source, said first and said second sides being adapted to reflect heat.

13. The method of claim 12, wherein said convection deflector is angled to form two sides, the angle being formed by the intersection of said first and said second sides.

14. The method of claim 12, further comprising:

providing a heat sink thermally coupled to said interface element and disposed within said first region.

15. The method of claim 12, wherein said heat sink includes heat-collecting fins.

16. The method of claim 12, wherein said heat sink comprises a block formed of thermally conductive material.

17. A heating apparatus, comprising:

a first region containing a heat source;

a second region separate from and thermally coupled with said first region via an interface element;

a heat sink thermally coupled to said interface element and disposed within said first region, said heat sink including fins and grooves;

a flue;

a convection deflector disposed within the interior of said first region along a gas flow path between said heat source and said flue to direct convective heat towards said interface element, said deflector extending to said fins of said heat sink and having a geometric shaped cross-section with a first side oriented towards said heat source to reflect gas flow toward said heat sink.

* * * * *